US006527369B1

(12) United States Patent
Weber et al.

(10) Patent No.: US 6,527,369 B1
(45) **Date of Patent: *Mar. 4, 2003**

(54) ASYMMETRIC PRINTHEAD ORIFICE

(75) Inventors: Timothy L. Weber, Corvallis, OR (US); David J. Waller, Corvallis, OR (US); Thomas W. Linder, Corvallis, OR (US)

(73) Assignee: Hewlett-Packard Company, Palo-Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/608,923

(22) Filed: Feb. 29, 1996

Related U.S. Application Data

(63) Continuation-in-part of application No. 08/547,885, filed on Oct. 25, 1995.

(51) Int. Cl.[7] ..... B41J 2/14; B41J 2/135
(52) U.S. Cl. ..... 347/47; 347/45
(58) Field of Search ..... 347/47, 45

(56) References Cited

U.S. PATENT DOCUMENTS

| | | | | |
|---|---|---|---|---|
| 4,550,323 A | | 10/1985 | Gamblin | 346/75 |
| 4,550,326 A | * | 10/1985 | Allen et al. | 346/140 R |
| 4,578,687 A | | 3/1986 | Cloutier et al. | 346/140 R |
| 4,611,219 A | | 9/1986 | Sugitani et al. | 346/140 R |
| 4,675,693 A | * | 6/1987 | Yano et al. | 346/1.1 |
| 4,701,766 A | * | 10/1987 | Sugitani et al. | 346/1.1 |
| 4,791,436 A | | 12/1988 | Chan et al. | 346/140 R |
| 4,823,149 A | | 4/1989 | Martner et al. | 346/140 R |
| 4,829,319 A | | 5/1989 | Chan et al. | 346/1.1 |
| 5,305,015 A | | 4/1994 | Schantz et al. | 346/1.1 |
| 5,451,993 A | | 9/1995 | Takahashi et al. | 347/47 |

FOREIGN PATENT DOCUMENTS

| | | | |
|---|---|---|---|
| EP | 0611154 A2 | 9/1986 | B41J/2/135 |
| EP | 0352468 A2 | 1/1990 | B41J/2/16 |
| EP | 0495663 A2 | 7/1992 | B41J/2/14 |
| EP | 0549211 A | 12/1992 | B41J/2/14 |
| EP | 0577383 A2 | 1/1994 | B41J/2/16 |
| EP | 0622198 A2 | 11/1994 | B41J/2/16 |

OTHER PUBLICATIONS

"The ThinkJet Orifice Plate: A Part With Many Functions"; by Gary L. Siewell, William R. Boucher, and Paul H. McClelland; Hewett–Packard Journal, May 1985 Issue; pp33–37.

"Thermal InkJet Review, or How Do Dots Get from the Pen to the Page"; by James P. Shields; Hewlett–Packard Journal, Aug. 1992 Issue; pp 67.

"Development of a High–Resolution Thermal InkJet Printhead"; by William A. Buskirk, David E. Hackleman, Stanley T. Hall, Paula H. Kanarek, Robert N. Low, Kenneth E. Trueba, and Richard R. Van de Poll; Hewlett–Packard Journal, Oct. 1988 Issue; pp 55–61.

Webster's II New Riverside Dictionary, The Riverside Publishing Company, pp 836, 1994.*

* cited by examiner

*Primary Examiner*—John Barlow
*Assistant Examiner*—Manish S. Shah
(74) *Attorney, Agent, or Firm*—Raymond A. Jenski

(57) ABSTRACT

A printhead for an inkjet printer employs asymmetric orifices, such as an egg-shaped orifice, at the surface of the orifice plate to cause the ink drop tail to be severed at a predictable location from the orifice. The controlled tail and diminished spray of an ink droplet expelled from the asymmetric orifice results in improved edge roughness and improved quality of print.

10 Claims, 7 Drawing Sheets

– PRIOR ART –

– PRIOR ART –

ASYMMETRIC PRINTHEAD ORIFICE

The present application is a continuation-in-part of U.S. patent application No 08/547,885 filed on Oct. 25, 1995.

BACKGROUND OF THE INVENTION

The present invention generally relates to the design of orifices used in an inkjet printer printhead and more particularly relates to orifices having at least one axis of asymmetry disposed in the orifice plate of an inkjet printer printhead.

An inkjet printer operates by positioning a medium, such as paper, in conjunction with a printing mechanism, conventionally known as a print cartridge, so that droplets of ink may be deposited in desired locations on the medium to produce text characters or images. The print cartridge may be scanned or reciprocated across the surface of the medium while medium is advanced increment by increment perpendicular to the direction of print cartridge travel. At any given point in the print cartridge travel and medium advancement operation, a command is given to an ink ejection mechanism to expel a tiny droplet of ink from the print cartridge to the medium. If the mechanism of ink expulsion is a thermally induced boiling of ink, the ink expulsion mechanism consists of a large number of electrically energized heater resistors which are preferentially heated in a small firing chamber, thereby resulting in the rapid boiling and expulsion of ink through a small opening, or orifice, toward the medium.

A conventional print cartridge for an inkjet type printer comprises an ink containment device and an ink-expelling apparatus, commonly known as a printhead, which heats and expels the ink droplets in a controlled fashion. Typically, the printhead is a laminate structure including a semiconductor or insulator base, a barrier material structure which is honeycombed with ink flow channels, and an orifice plate which is perforated with circular nozzles or orifices with diameters smaller than a human hair and arranged in a pattern which allows ink droplets to be expelled. Thin film heater resistors are deposited on or near the surface of the base and are usually protected from corrosion and mechanical abrasion by one or more protective layers. The thin film heater resistors are electrically coupled to the printer either directly via metalization on the base and subsequent connectors or via multiplexing circuitry, metalization, and subsequent connectors. Microprocessor circuitry in the printer selectively energizes particular thin film heater resistors to produce the desired pattern of ink droplets necessary to create a text character or a pictorial image. Further details of printer, print cartridge, and printhead construction may be found in the Hewlett-Packard Journal, Vol. 36, No. 5, May 1985, and in the Hewlett-Packard Journal, Vol. 45, No. 1, February 1994.

Ink flows into the firing chambers formed around each heater resistor by the barrier layer and the orifice plate and awaits energization of the heater resistor. When a pulse of electric current is applied to the heater resistor, ink within the firing chamber is rapidly vaporized, forming a bubble which rapidly ejects a mass of ink through the orifice associated with the heater resistor and the surrounding firing chamber. Following ejection of the ink droplet and collapse of the ink bubble, ink refills the firing chamber and forms a meniscus across the orifice. The form and constrictions in channels through which ink flows to refill the firing chamber establish the speed at which ink refills the firing chamber and the dynamics of the ink meniscus.

One of the problems faced by designers of print cartridges is that of maintaining a high quality of result in print while achieving a high rate of printing speed. When a droplet is expelled from an orifice due to the rapid boiling of the ink inside the firing chamber, most of the mass of the ejected ink is concentrated in the droplet which is directed toward the medium. However, a portion of the expelled ink resides in a tail extending from the droplet to the surface opening of the orifice. The velocity of the ink found in the tail is generally less than the velocity of the ink found in the droplet so that at some time during the trajectory of the droplet, the tail is severed from the droplet. Some of the ink in the severed tail rejoins the expelled droplet or remains as a tail and creates rough edges on the printed material. Some of the expelled ink in the tail returns to the printhead, forming puddles on the surface of the orifice plate of the printhead. Some of the ink on the severed tail forms subdroplets ("spray") which spreads randomly in the general area of the ink droplet. This spray often lands on the medium to produce a background of ink haze. To reduce the detrimental results of spray, others have reduced the speed of the printing operation but have suffered a reduction in the number of pages which a printer can print in a given amount of time. The spray problem has also been addressed by optimizing the architecture or geometry of the firing chamber and the associated ink feed conduits. In many instances, however, very fine optimization is negated by variables of the manufacturing process. The present invention overcomes the problem of spray and uncontrolled tail without introducing a reduction in print speed or fine ink channel architecture optimizations.

SUMMARY OF THE INVENTION

A printhead for an inkjet printer and methods for making and using the printhead includes an ink ejector and an orifice plate having at least one orifice from which ink is expelled, extending through the orifice from a first surface of the orifice plate abutting the ink ejector to a second surface of the orifice plate. The at least one orifice has at least one axis of symmetry.

DETAILED DESCRIPTION OF A PREFERRED EMBODIMENT

Figure 1:
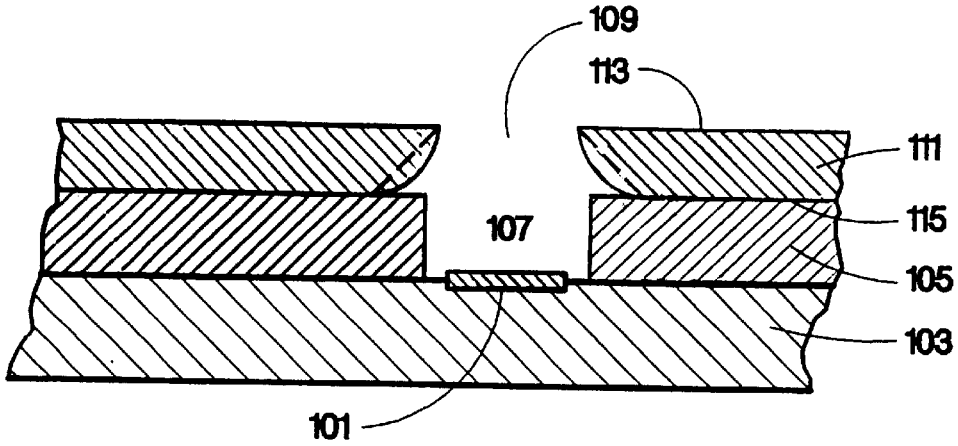
FIG. 1 is a cross sectional view of a conventional printhead showing one ink firing chamber.

A cross section of a conventional printhead is shown in FIG. 1. A thin film resistor 101 is created at the surface of a semiconductor substrate 103 and typically is connected to electrical inputs by way of metalization (not shown) on the surface of the semiconductor substrate 103. Additionally, various layers of protection from chemical and mechanical attack may be placed over the heater resistor 101, but is not shown in FIG. 1 for clarity. A layer of barrier material 105 is selectively placed on the surface of the silicon substrate 103 thereby leaving an opening or firing chamber 107 around the heater resistor 101 so that ink may accumulate prior to activation of heater resistor 101 and expulsion of ink through an orifice 109. The barrier material for barrier layer 105 is conventionally Parad® available from E.I. Dupont De Nemours and Company or equivalent material. The orifice 109 is a hole in an orifice plate 111 which is typically formed by gold plating a nickel base material. Such a plating operation results in a smooth curved taper from the outer surface 113 of the orifice plate 111 to the inner surface 115 of the orifice plate 111, which faces the firing chamber 107 and the firing resistor 101. The orifice outlet at the outer surface of orifice plate 11 has a smaller radius (and therefore a smaller area of opening) than the orifice plate opening to the firing chamber 107. Other methods of producing orifices, such as laser ablation may be used, particularly with orifice plates of materials other than metal, but such other orifice production methods can generate orifices with straight sides, shown in phantom.

Figure 2:
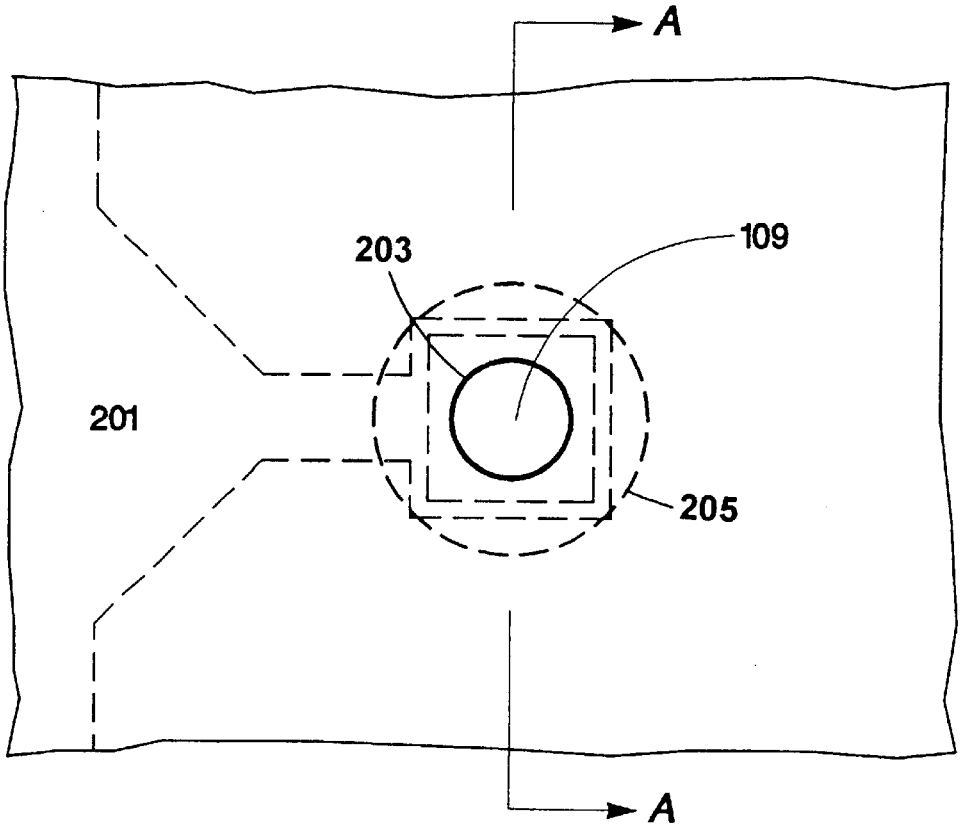
FIG. 2 is a plan view from the outer surface of the orifice plate of a conventional printhead.

FIG. 2 is a top plan view of the printhead (indicating the section A—A of FIG. 1), viewing orifice 109 from the outer surface 113 of the orifice plate 111 in which an opening 203 in the outer surface is shown in solid line and an opening 205 at the inner surface is shown in broken line. An ink feed channel 201 is present in the barrier layer 105 to deliver ink to the firing chamber from a larger ink source (not shown).

Figure 3:
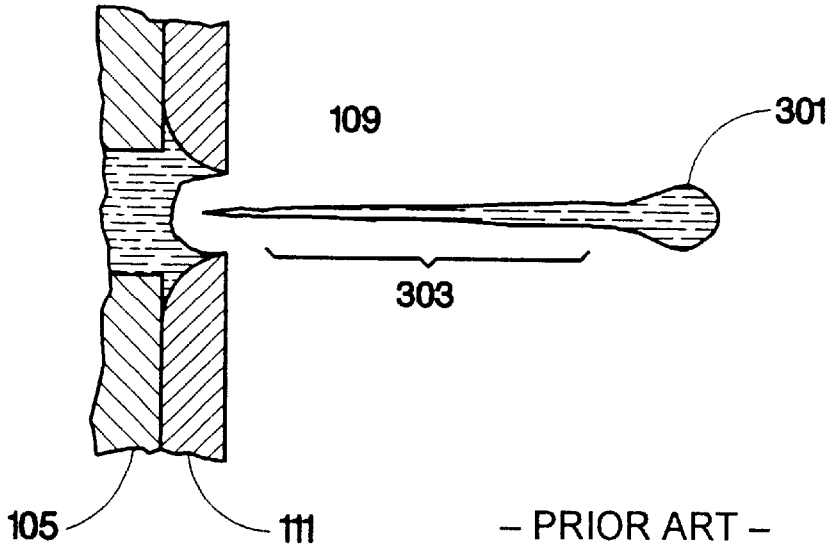
FIG. 3 is a cross sectional view of a conventional printhead illustrating the expulsion of an ink droplet.

FIG. 3 illustrates the configuration of ink in an ink droplet 301 at a time of 22 microseconds after the ink has been expelled from the orifice 109. In conventional orifice plates, in which circular orifices are used, the ink droplet 301 maintains a long tail 303 which extends back to at least the orifice 109 in the orifice plate 111. After the droplet 301 leaves the orifice plate and the bubble of vaporized ink which expelled the droplet collapses, capillary forces draw ink from the ink source through the ink feed channel 201. In an underdamped system, ink rushes back into the firing chamber so rapidly that it overfills the firing chamber 107, thereby creating a bulging meniscus. The meniscus then oscillates about its equilibrium position for several cycles before settling down. Extra ink in the bulging meniscus adds to the volume of an ink droplet should a droplet be expelled while the meniscus is bulging. A retracted meniscus reduces the volume of the droplet should the droplet be expelled during this part of the cycle. Printhead designers have improved and optimized the damping of the ink refill and meniscus system by increasing the fluid resistance of the ink refill channel. Typically this improvement has been accomplished by lengthening the ink refill channel, decreasing the ink refill channel cross section, or by increasing the viscosity of the ink. Such an increase in ink refill fluid resistance often results in slower refill times and a reduced rate of droplet ejection and printing speed.

Figure 4:
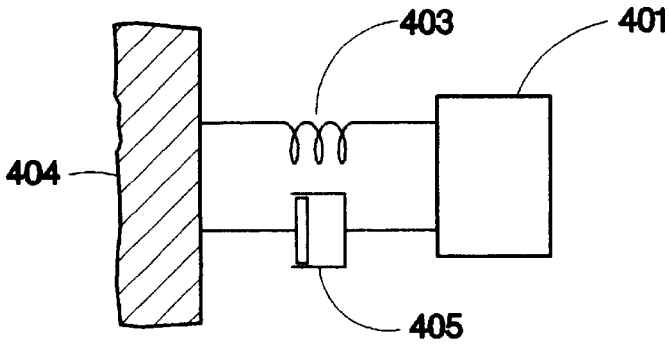
FIG. 4 is a theoretical model of the droplet/meniscus system which may be useful in understanding a feature of the present invention.

A simplified analysis of the meniscus system is one such as the mechanical model shown in FIG. 4, in which a mass 401, equivalent to the mass of the expelled droplet, is coupled to a fixed structure 404 by a spring 403 having a spring constant, K, proportional to the reciprocal of the effective radius of the orifice. The mass 401 is also coupled to the fixed structure 404 by a damping function 405 which is related to the channel fluid resistance and other ink channel characteristics. In the preferred embodiment, the drop weight mass 401 is proportional to the diameter of the orifice. Thus, if one desires to control the characteristics and performance of the meniscus, one may adjust the damping factor of the damping function 405 by optimizing the ink channel or adjusting the spring constant of spring 403 in the mechanical model.

Figure 6A:
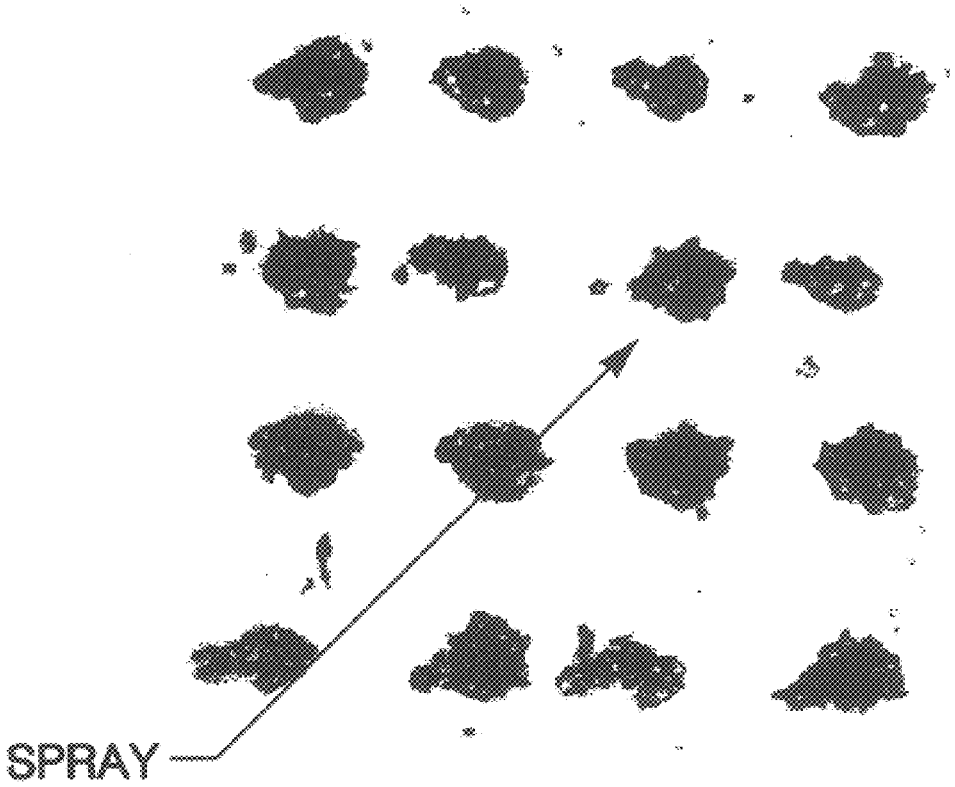
FIG. 6A is a reproduction of the detrimental effects of spray and elongated tail upon a printed medium.

Returning again to FIG. 3, when the droplet 301 is ejected from the orifice most of the mass of the droplet is contained in the leading head of the droplet 301 and the greatest velocity is found in this mass. The remaining tail 303 contains a minority of the mass of ink and has a distribution of velocity ranging from nearly the same as the ink droplet head at a location near the ink droplet head to a velocity less than the velocity of the ink found in the ink droplet head and located closest to the orifice. At some time during the transit of the droplet, the ink in the tail is stretched to a point where the tail is broken. A portion of the ink remaining in the tail is driven back to the printhead orifice plate 111 where it typically forms puddles of ink surrounding the orifice. These ink puddles degrade the quality of the printed material by causing misdirection of subsequent ink droplets. Other parts of the ink droplet tail are absorbed into the ink droplet head prior to the ink droplet being deposited upon the medium. Finally, some of the ink found in the ink droplet tail neither returns to the printhead nor remains with or is absorbed in the ink droplet, but produces a fine spray of subdroplet size spreading in a random direction. Some of this spray reaches the medium upon which printing is occurring thereby producing rough edges to the dots formed by the ink droplet and placing undesired spots on the medium which reduces the clarity of the desired printed material. Such an undesired result is shown in the representation of printed dots in FIG. 6A.

Figure 5:
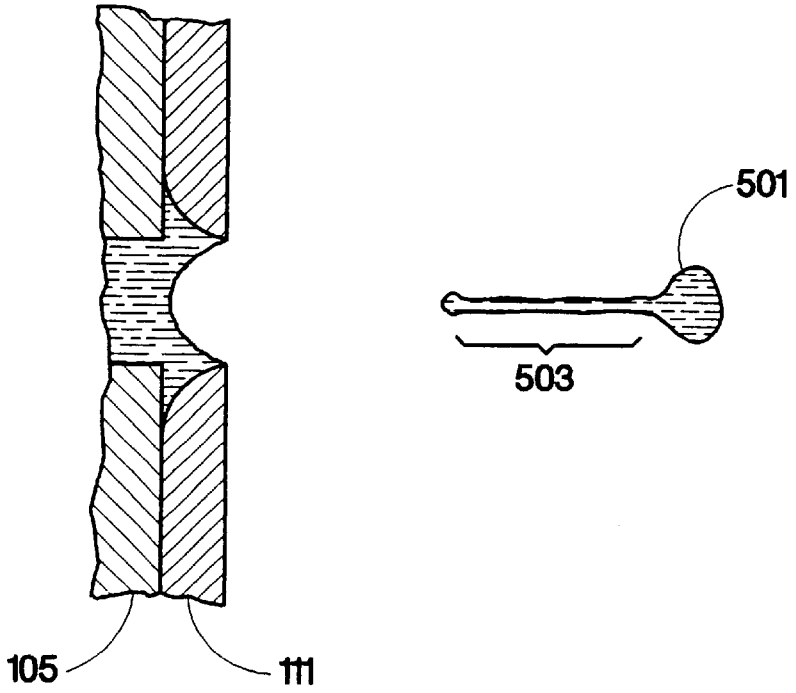
FIG. 5 is a cross sectional view of a printhead which may employ the present invention and illustrating the expulsion of an ink droplet.
Figure 6B:
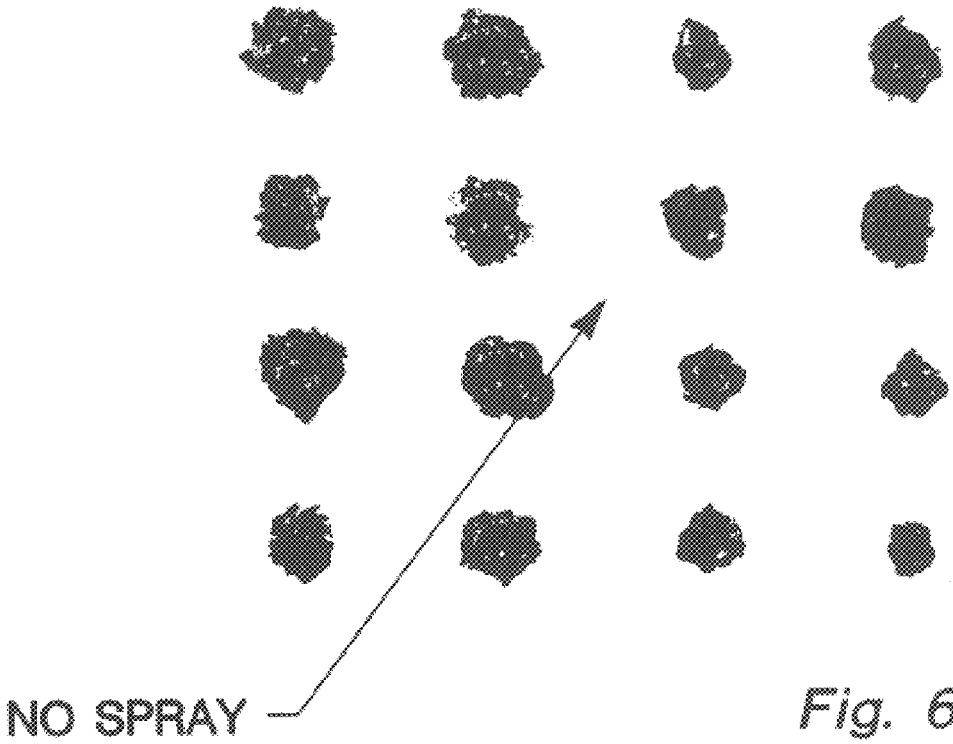
FIG. 6B is a reproduction of a printed medium illustrating reduction of spray.

It has been determined that the exit area of the orifice 109 defines the drop weight of the ink droplet expelled. It has further been determined that the spring constant K in the model (the restoring force of the meniscus) is determined in part by the proximity of the edges of the opening of the orifice at the outer surface 113 of the orifice plate 111. Thus, to increase the stiffness of the meniscus, the sides and opening of the orifice at the outer surface 113 of the orifice plate 111 should be made as close together as possible. This, of course, is in contradiction to the need to maintain a given drop weight for the droplet (which is determined by the exit area of the orifice). It is a feature, then, of the present invention that that the opening of the orifice at the outer surface 113 of the orifice plate 111 be of a non-circular geometry. A greater restoring force on the meniscus provided by the non-circular geometry causes the tail of the ink droplet to be broken off sooner and closer to the orifice plate thereby resulting in a shorter ink droplet tail and substantially reduced spray. Such an effect is shown in FIG. 5 which illustrates an ink droplet 22 microseconds after being ejected from the orifice 501. The ink droplet tail 503 has been broken off sooner and is shorter than that created by the circular orifice of FIG. 3. Printed dots resulting from the ink droplet ejected from non-circular orifices is shown in FIG. 6B. It is notable that spray has been essentially eliminated from this resulting sample and the edge roughness has been substantially improved.

Some non-circular orifices which may be utilized are elongate apertures having a major axis and a minor axis, in which the major axis is of a greater dimension than the minor axis and both axes are parallel to the outer surface of the orifice plate. Such elongate structures can be rectangles and parallelograms or ovals such as ellipses and parallel-sided "racetrack" structures. Using the ink found in model no HP5 1649A print cartridges, available from Hewlett-Packard Company, and orifice surface opening areas equal to the area of the orifice surface opening area found in the HP5 1649A cartridge it was determined that the range of effective operation for an ellipse having a major axis to minor axis ratio of from 2 to 1 through a major axis to a minor axis ratio of 5 to 1 demonstrated the desired meniscus stiffening and short tail ink droplet.

Figure 7A:
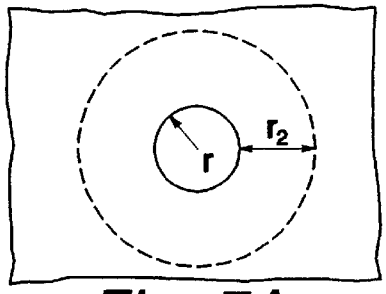
FIGS. 7A–7E are plan views from the outer surface of the orifice plate showing orifice surface apertures.
Figure 7B:
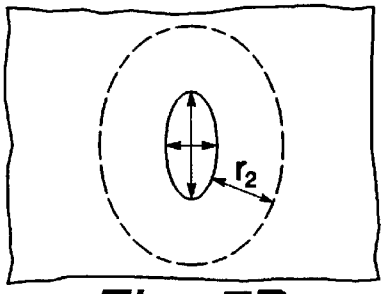
Figure 7C:
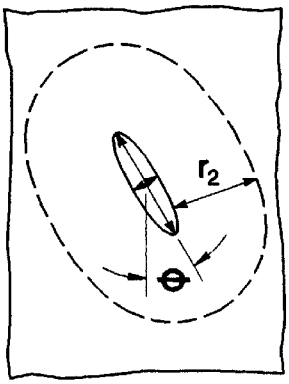
Figure 7D:
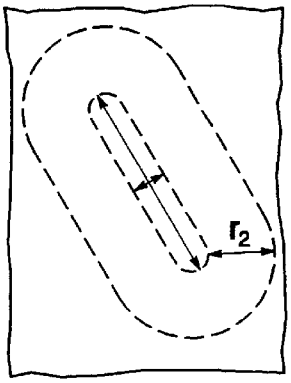
Figure 7E:
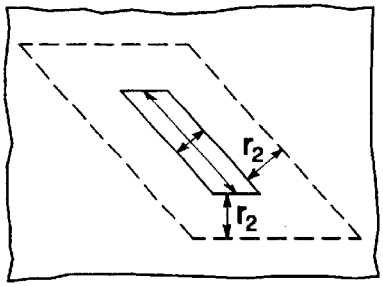

FIGS. 7A–7D are plan views of the orifice plate outer surface illustrating the various types of orifice dimensions. FIG. 7A illustrates a circular orifice having a radius r at the outer dimension and a difference in radius between the outer dimension r and the opening to the firing chamber of value $r_2$. In the preferred embodiment, r=17.5 micron and $r_2$=45 microns. This yields an aperture area at the orifice plate outer surface ($r^2 \cdot \pi$) of 962 microns$^2$. The arrows drawn across the orifice outside surface aperture indicate the major and minor axes. FIG. 7B illustrates an ellipsoidal outside orifice aperture geometry in which the major axis/minor axis ratio equals 2 to 1 and, in order to maintain an equal droplet drop weight, the outer surface area is maintained at 962 microns$^2$. The inner dimension of the aperture bore maintains a greater size by the later radius increment $r_2$. FIG. 7C illustrates an orifice having a major axis/minor axis ratio of 4 to 1 and an outside aperture area of 962 microns$^2$. FIG. 7D illustrates an oval "racetrack" orifice outside geometry in which the major axis/minor axis ratio is equal to 5 to 1 and a difference of $r_2$. FIG. 7E illustrates a parallelogram orifice outside geometry having a major axis/minor axis ratio of 5 to 1 and a difference between the inside geometry and outside geometry of $r_2$ from the periphery of the outside surface orifice dimension. Those aperture geometries having a major axis/minor axis ratio greater than 2 to 1 require a rotation of approximately 30° (θ=30°) so that adjacent orifices can be spaced closely together.

Figure 8:
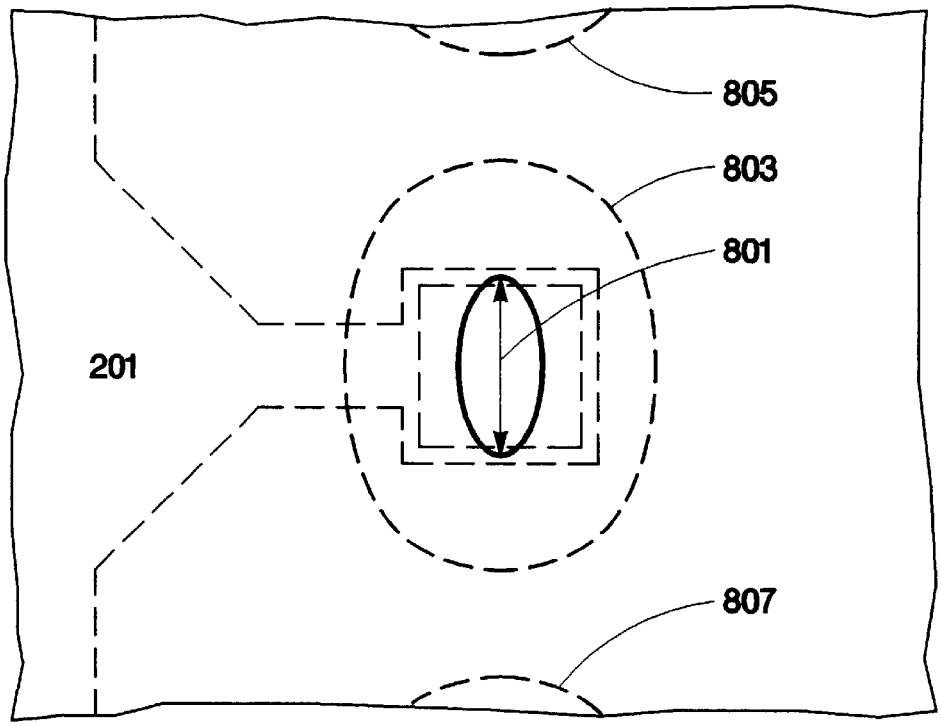
FIG. 8 is a plan view from the outer surface of the orifice plate showing an elongate orifice surface aperture relative to the firing chamber and ink replenishment flow direction.
Figure 9:
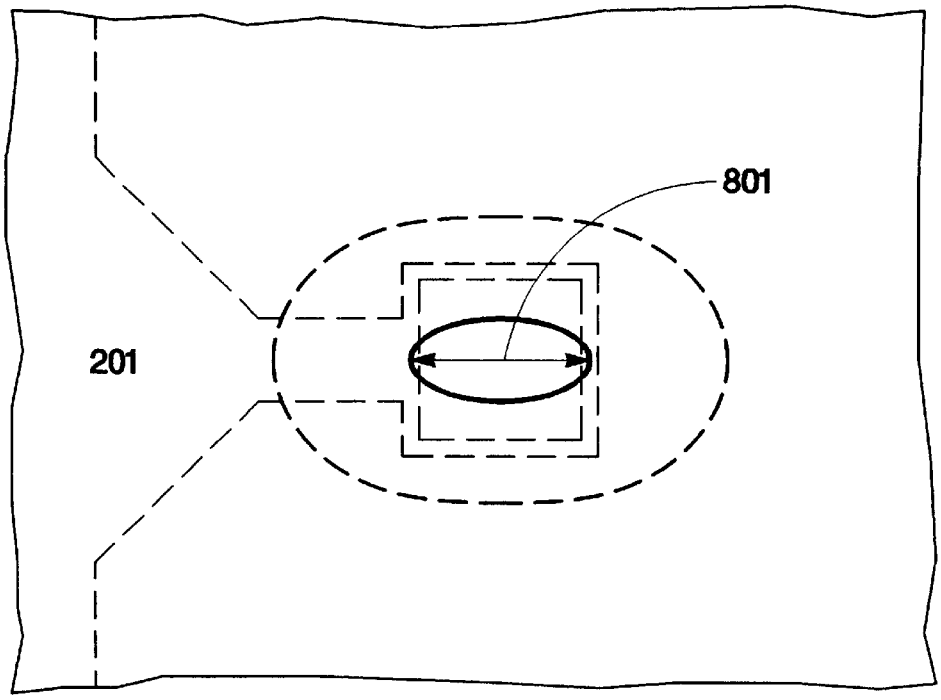
FIG. 9 is a plan view from the outer surface of the orifice plate showing an alternative elongate orifice surface aperture relative to the firing chamber and ink replenishment flow direction.

Referring now to FIG. 8, a plan view of the orifice plate illustrates an orientation of the oval orifice aperture oriented such that the major axis of the oval 801 is oriented perpendicular to the flow of ink into the firing chamber via the ink feed channel 201. FIG. 9 illustrates the same oval aperture in which the major axis 801 is oriented parallel to the direction of ink flow into the firing chamber from the ink feed channel 201. In those embodiments in which the non-circular orifice has a major axis/minor axis ratio greater than 2 to 1 and is oriented perpendicular to the ink flow from the ink feed channel 201, such as shown in FIG. 8, the orifices are oriented at an angle deviating from perpendicularity by θ=approximately 30°. This orientation enables orifices to be closely spaced without causing the inner orifice dimensions 803, 805, 807 to touch or interfere with each other. The angle of deviation from perpendicularity, θ, may range from 0° to 45° in alternative embodiments of the invention. It has been determined that the preferred non-circular orifice orientation for orifice plates which are formed of metal, for example gold plated nickel (and which have a curved smoothly tapering orifice from the outer surface of the orifice plate to the inner surface of the orifice plate), is that of having the long axis of the elongate orifice perpendicular to the direction of ink refill flow from the ink feed channel 201, such as that shown in FIG. 8. For those orifice plates such as those formed of softer materials like polyimide in which the orifices are created by laser ablation (and which have a relatively linear orifice from the outer surface of the orifice plate to the inner surface of the orifice plate the preferred non-circular orientation is that of having the long axis of the elongate orifice being parallel to the flow of ink from the ink feed channel 201, such as shown in FIG. 9.

Referring again to FIG. 5, the cross section shown in FIG. 5 is that along the major axis of the elongate orifice aperture. The ink droplet head 501, after emerging from the orifice, is a non-spherical ink droplet, distorted in the direction of the major axis of the elongate orifice. The ink droplet oscillates during its flight path to the medium, forming a more conventional teardrop shape by the time it reaches the medium. The droplet has a significantly reduced tail and a significant reduction in spray without sacrificing printing speed and without ink channel optimizations requiring extreme manufacturing tolerances.

Figure 10:
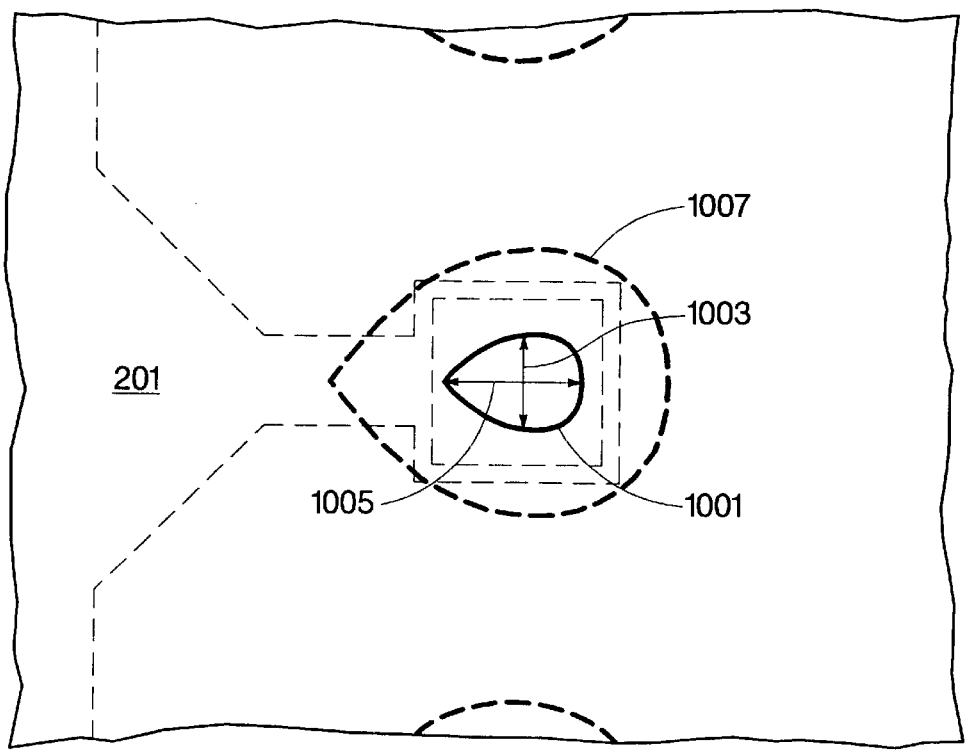
FIG. 10 is a plan view from the outer surface of the orifice plate showing an eggshaped orifice surface aperture having an axis of asymmetry.

It is desirable that the ejected ink droplet tail be severed from a predictable location. It is a feature of the present invention that the orifices be provided a cusp or sharp radius of curvature as viewed from the orifice plate surface. A preferred embodiment of such a cusped orifice is shown in the orifice plate plan view of FIG. 10. The opening 1001 of the orifice on the orifice plate outer surface has at least one axis of asymmetry (as illustrated in broken line shape 1107 of the orifice opening at the inner surface of the orifice plate in FIG. 11 as well as broken line shape 1007 of the orifice opening at the inner surface of the orifice plate in FIG. 10) thereby providing one end of the orifice with a sharper radius of curvature than the other. The asymmetric, non-circular orifice has a localized area of high radius of curvature (a cusp) which attracts the ink-jet tail regardless of orifice orientation over the ink refill channel. As will be described below the cusp of the orifice is shown oriented in one direction in FIG. 10 but can and will be oriented in other directions.

Figure 11:
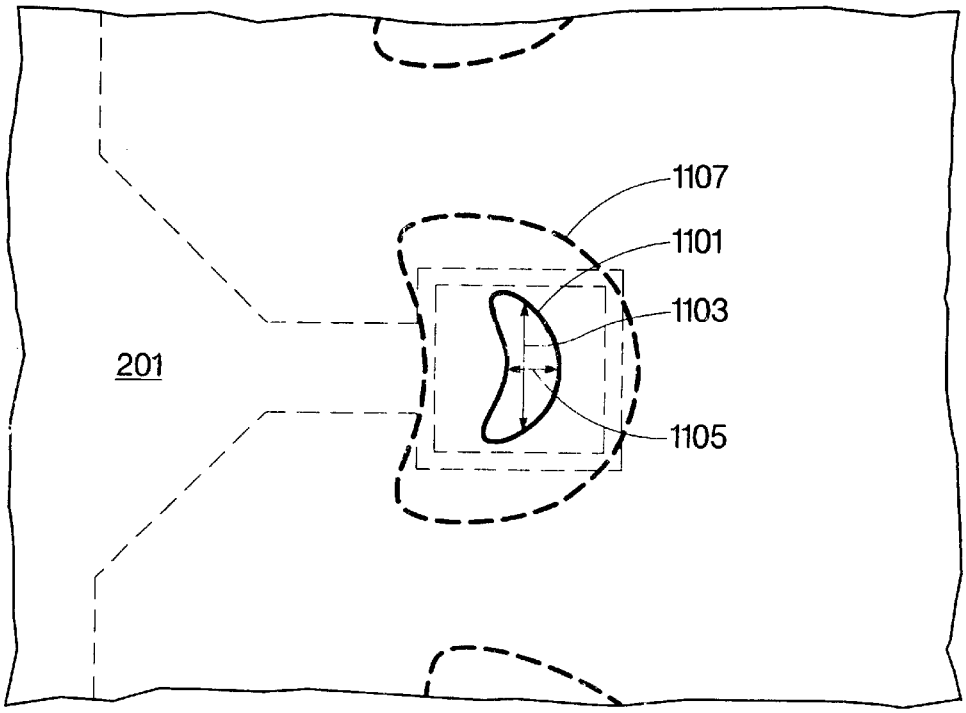
FIG. 11 is a plan view from the outer surface of the orifice plate showing a crescent moon-shaped orifice surface aperture having an axis of asymmetry.

An alternative embodiment of a cusped orifice is shown in the orifice plate outer surface plan view of FIG. 11. A two-cusped geometry orifice 1101, crescent moon-shaped, and having an axis of asymmetry 1103 perpendicular to an axis of symmetry 1005, each axis oriented parallel to an outer surface of the orifice plate is oriented over the thin film resistor. As in previous designs, the preferred embodiment geometry is retained through the length of the orifice (as illustrated in broken line shape 1107 of the orifice opening at the inner surface of the orifice plate in FIG. 11 as well as broken line shape 1007 of the orifice opening at the inner surface of the orifice plate in FIG. 10) for ease of manufacture. The orifices of FIGS. 10 and 11 may be fabricated b y polyimide laser-ablation techniques or by micromolding. The bore of FIG. 10 may also be fabricated using conventional nickel-plating techniques with the substitution of the non-circular-geometry for the circular carbide button.

Figure 12:
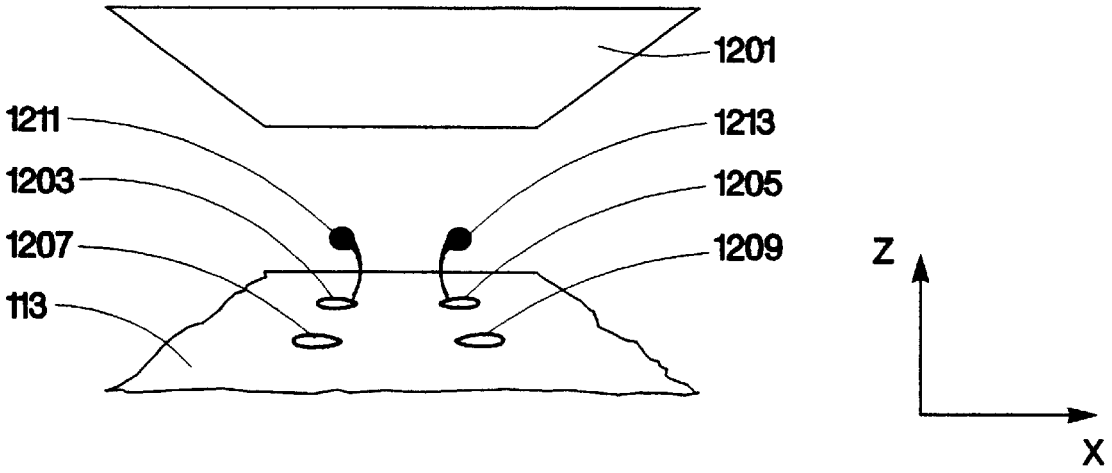
FIG. 12 is a perspective view of the region between the outer surface of an orifice plate and a sheet of media in an inkjet printer.

The advantages of the cusped orifice can be appreciated in conjunction with FIG. 12. A perspective view of the small region of an inkjet printer between the outer surface 113 of an orifice plate and a media sheet 1201, such as paper. The orifice plate is manufactured with cusped orifices 1203, 1205, 1207, and 1209. An ink droplet 1211 has been expelled from orifice 1203 in the+z direction and an ink droplet 1213 has been expelled from orifice 1205 also in the+z direction. A tail of ink follows the expelled droplets.

An ink droplet tail has a lower velocity magnitude in the x and z axes than the larger, faster main drop. In previous designs using circular orifices, this low-energy tail is often attracted by ink puddles on the orifice plate outer surface at the periphery of the orifice, which alter the tail's trajectory so that it becomes spray around the main drop. However, ejecting the drop from a cusped bore causes the tail to be consistently attracted to the localized area of high surface tension at the cusped end of the orifice, regardless of puddling. It has been found that this attraction and tail break-off is not dependent on orientation of the orifice over the firing chamber.

In conventional inkjet printers, the printhead is transported or moved in the+/−× direction relative to the media 1201 and selected ones of the resistors underlying the orifices are activated to eject ink from the orifices. Thus a pattern of ink dots are placed upon the media. When the printhead reaches the end of its scan range, it can either retrace its path of transportation in the opposite x direction expelling ink from other orifices (thereby filling in gaps between previously printed dots) or the media can be advanced one increment in the y direction (perpendicular to both the x and z axes) and printing of dots commenced in the opposite x direction. Of course, it is possible for dot printing to occur in just one of the+or−×directions.

It can be seen that when the printhead is transported in the+x direction, the slower-moving tail of droplet 1211 (in the z direction), which is consistently drawn to the cusp end of the orifice opening, will land on the media 1201 behind the head of the ink droplet. However, the slower-moving tail of droplet 1213 drawn slightly ahead of the droplet by the cusped orifice will land on top of the dot formed by droplet 1213 resulting in a rounder, tail-free spot on the media 1201.

Figure 13:
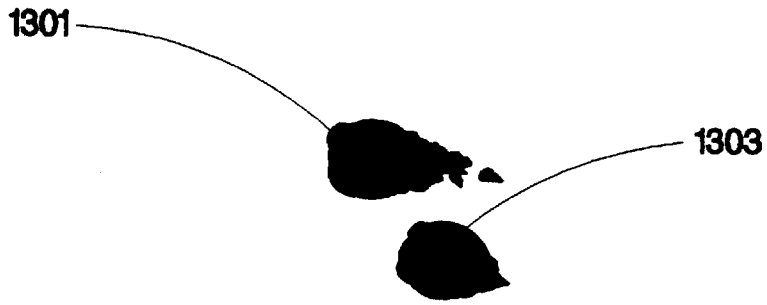
FIG. 13 is a representation of two dots printed on a sheet of media comparing the results of droplet tails correlated and anticorrelated with the direction of printhead movement.

The placement of the tail on the printed page is influenced by coordinating the orientation of the orifice cusp with the carriage velocity, as shown in FIG. 13. The printed dot 1301 reveals an extended and messy drop configuration resulting from the tail displacement and spray corresponding to droplet 1211. The dot 1303, corresponding to droplet 1213, printed on the media shows the resulting dot crispness when the tail and associated spray fall within the dot formed by the head of the ink droplet. Thus, print quality from an inkjet printer is improved when orifices having at least one axis of asymmetry are coordinated with the direction of printhead movement.

What is claimed is:

1. A printhead for an inkjet printer including orifices from which ink is expelled, comprising:

an ink ejector, and an orifice plate having at least one ink expelling orifice extending through said orifice plate from an inner surface of said orifice plate opposite said ink ejector to an outer surface of said orifice plate, said at least one ink expelling orifice having at least one cusped radius of curvature and an axis of asymmetry perpendicular to an axis of symmetry, both said axes being parallel to said outer surface.

2. A printhead in accordance with claim 1 wherein said orifice plate having said at least one ink expelling orifice further comprises an opening of said at least one ink expelling orifice at said outer surface having a smaller area and essentially the same geometric shape as an opening of said at least one ink expelling orifice at said inner surface.

3. A printhead in accordance with claim 1 wherein said ink expelling orifice opening further comprises an opening of said at least one ink expelling orifice being an egg-shaped geometric area.

4. A printhead in accordance with claim 1 wherein said ink expelling orifice opening further comprises an opening of said at least one ink expelling orifice being a crescent moon-shaped geometric area.

5. A method of operation of a printhead for an inkjet printer including orifices through an orifice plate from which ink is expelled, comprising the steps of:

expelling a mass of ink as a droplet from at least one ink expelling orifice in the printhead; and severing a tail of said expelled droplet aided by an opening of at least one of the ink expelling orifices on an outer surface of the orifice plate, said opening having at least one cusped radius of curvature and an axis of asymmetry perpendicular to an axis of symmetry, both axes being parallel to said outer surface.

6. A method in accordance with the method of claim 5 further comprising the step of moving the printhead in at least one direction past a medium upon which ink is to be deposited.

7. A method of manufacturing a printhead for an inkjet printer including orifices from which ink is expelled, comprising the steps of:

disposing an ink ejector on a substrate;

overlaying an orifice plate on said substrate; and extending at least one ink expelling orifice through said orifice plate from an inner surface of said orifice plate opposite said ink ejector to an outer surface of said orifice plate, said at least one ink expelling orifice having at least one cusped radius of curvature and an axis of asymmetry perpendicular to an axis of symmetry, both said axes being parallel to said outer surface.

8. A method in accordance with the method of claim 7 wherein said step of extending at least one ink expelling orifice further comprises the step of creating said ink expelling orifice having an opening of said at least one ink expelling orifice at said outer surface with a smaller area and essentially the same geometric shape as an opening of said at least one ink expelling orifice at said inner surface.

9. A method in accordance with the method of claim 7 wherein said step of creating said ink expelling orifice opening further comprises the step of creating said ink expelling orifice opening having an essentially egg-shaped geometric area at said outer surface.

10. A method in accordance with the method of claim 7 wherein said step of creating said ink expelling orifice opening further comprises the step of creating said ink expelling orifice opening having an essentially crescent moon-shaped geometric area at said outer surface.

* * * * *